US006549112B1

(12) United States Patent
Gallina et al.

(10) Patent No.: US 6,549,112 B1
(45) **Date of Patent: *Apr. 15, 2003**

(54) EMBEDDED VERTICAL SOLENOID INDUCTORS FOR RF HIGH POWER APPLICATION

(75) Inventors: Jan S. Gallina, Torrance, CA (US); Michael Brand, Los Angeles, CA (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/705,476

(22) Filed: Aug. 29, 1996

(51) Int. Cl.[7] ..... H01F 5/00
(52) U.S. Cl. ..... 336/200; 336/223; 336/232
(58) Field of Search ..... 336/69, 200, 230, 336/232, 223

(56) References Cited

U.S. PATENT DOCUMENTS 3,785,046 A * 1/1974 Jennings ..... 29/602
4,313,152 A * 1/1982 Vranken ..... 361/402
4,613,843 A * 9/1986 Esper et al. ..... 336/232
5,250,923 A * 10/1993 Ushiro et al. ..... 336/83
5,398,400 A * 3/1995 Breen ..... 29/602.1
5,530,415 A * 6/1996 Takaya et al. ..... 336/83
5,559,360 A * 9/1996 Chiu et al. ..... 257/531
5,572,179 A * 11/1996 Ito et al. ..... 336/200
5,610,433 A * 3/1997 Merrill et al. ..... 336/200

FOREIGN PATENT DOCUMENTS

JP 579-58805 * 4/1984 ..... 336/200

* cited by examiner

*Primary Examiner*—Anh Mai
(74) *Attorney, Agent, or Firm*—Leonard A. Alkov; Glenn H. Lenzen, Jr.

(57) ABSTRACT

Vertical solenoid inductors have windings or layers which are arranged to minimize interwinding capacitance between adjacent layers. Each layer occupies a surface area, and adjacent layers are arranged to occupy different surface areas, except where necessary to provide electrical connection between adjacent layers. The inductors are high power inductors which have high inductances L and high current capabilities. The inductors of the present invention also have high self resonant frequencies and quality factors, while minimizing component volume.

14 Claims, 3 Drawing Sheets

EMBEDDED VERTICAL SOLENOID INDUCTORS FOR RF HIGH POWER APPLICATION

BACKGROUND OF THE INVENTION

1. Field of the Invention

This invention relates generally to inductors, and, more particularly, to a design of inductors for high power, radio frequency applications having an optimal combination of self resonant frequency and quality factor while minimizing component volume.

2. Discussion

Inductors are typically used as devices for storing energy in electrical circuits. An inductor has many uses in the field of electronics. In particular, inductors find applications in filters, tuned circuits, energy storage devices, and electrical measuring devices. Inductors are often used in radio frequency (RF), high power applications as well.

Because many RF, high power applications require high power processing densities, it is advantageous to be able to provide inductors which require a minimum of space, weight, and cost for production. These requirements have spawned a class of printed inductors which desirably have high inductances and can handle relatively high currents.

Such varied inductors preferably provide an optimal combination of self resonant frequency (SRF) and quality factor (Q) while minimizing component volume.

Present inductors are embodied as spiral inductors, which are flat inductors printed on a single substrate layer. Spiral inductors, however, exhibit low inductance and high resistance, resulting in a low Q which is unacceptable for high power applications. Further, the spiral inductor yields a relatively small inductor value (L), which is not commensurate with the large surface area that the inductor requires.

Thus, it is an object of the present invention to provide a high power inductor which has a high inductance value L and high current capacities.

It is a further object of this invention to provide an inductor having a desirable combination of SRF and quality factor Q, but which requires minimum component volume.

It is yet a further object of the present invention to provide an inductor which improves the efficiency, decreases the size, and increases the power density of very high frequency (VHF) power supplies and RF circuits in general.

It is yet a further object of the present invention to provide a pyramid, vertical solenoid inductor having minimal inner-edge spacing between adjacent traces, thereby resulting in a reduction of the component surface area.

It is a further object of the present invention to provide a pyramid, vertical solenoid inductor exhibiting less proximity effect than typical spiral structures.

It is yet a further object of the present invention to provide a staggered, vertical, solenoid inductor which eliminates conductor overlap between adjacent turns of the inductor in order to minimize parasitic capacitance and maximize component SRF.

It is yet a further object of the present invention to provide a staggered vertical solenoid inductor of sufficiently reduced height without affecting the SRF performance characteristic.

SUMMARY OF THE INVENTION

In accordance with the teachings of the present invention, this invention is directed to vertical solenoid inductors which includes a plurality of adjacent layers. Each layer is arranged to minimize overlap with adjacent layers in order to minimize electrical interaction between each layer. Each layer is then electrically connected by a via.

Additional objects, features and advantages of the present invention will become apparent from the following description and the appended claims, taken in connection with the accompanying drawings.

DETAILED DESCRIPTION OF A PREFERRED EMBODIMENT

Figure 1:
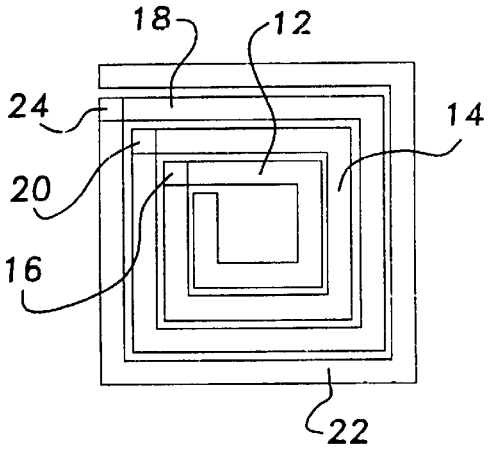
FIG. 1 is a plan view of a pyramid solenoid inductor arranged in accordance with the principles of the present invention.
Figure 2:
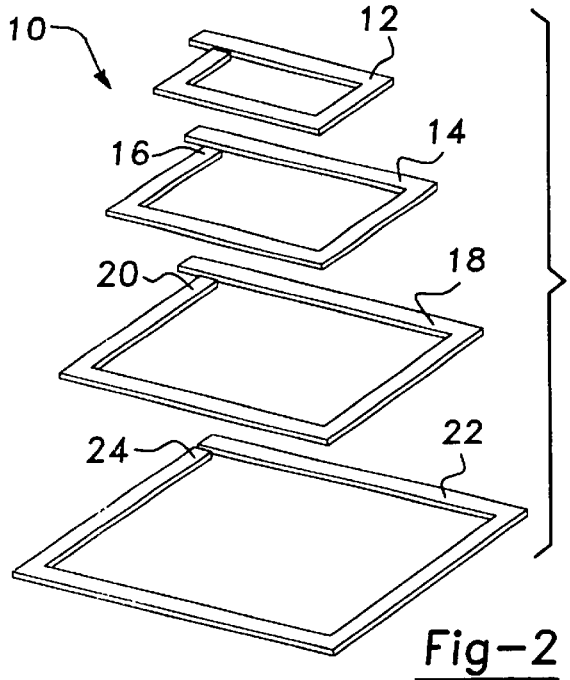
FIG. 2 is an exploded perspective view of the pyramid solenoid inductor of FIG. 1.
Figure 3:
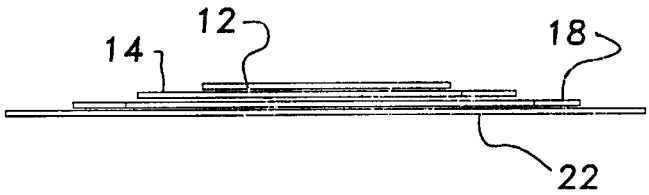
FIG. 3 is a side view of the pyramid solenoid inductor of FIG. 1.
Figure 4:
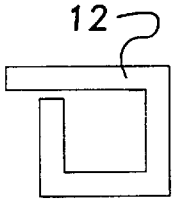
FIG. 4 is a plan view of the uppermost layer of the pyramid solenoid inductor of FIG. 1.
Figure 5:
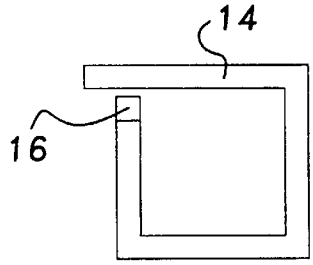
FIG. 5 is a plan view of the second layer of the pyramid solenoid inductor, which is adjacent to the layer of FIG. 4.
Figure 6:
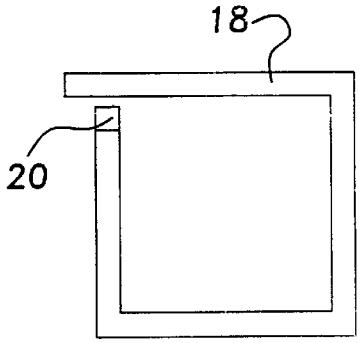
FIG. 6 is a plan view of the third layer of the pyramid solenoid inductor, which is adjacent to the layer of FIG. 5.
Figure 7:
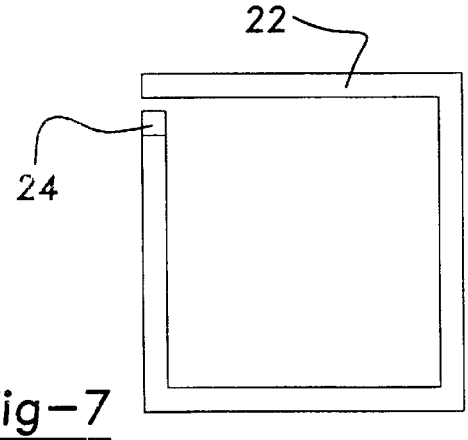
FIG. 7 is a plan view of a fourth layer of the pyramid solenoid inductor, which is adjacent to the layer of FIG. 6.
Figure 8:
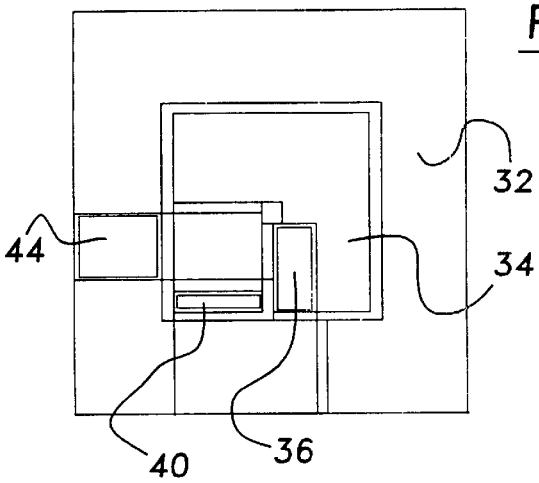
FIG. 8 is a plan view of a staggered solenoid inductor arranged in accordance with a second embodiment of the principles of the present invention.
Figure 9:
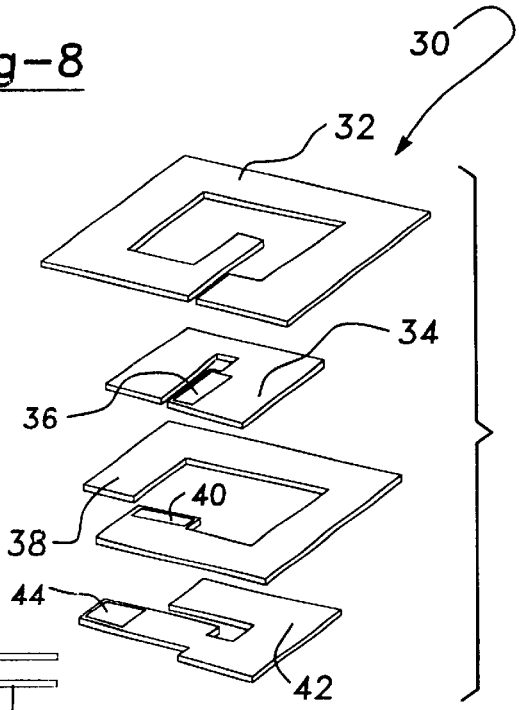
FIG. 9 is an exploded perspective view of the staggered solenoid inductor of FIG. 8.
Figure 10:
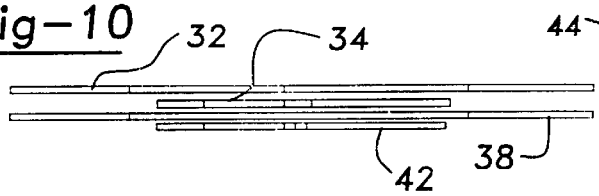
FIG. 10 is a side view of the staggered solenoid inductor of FIG. 8.
Figure 11:
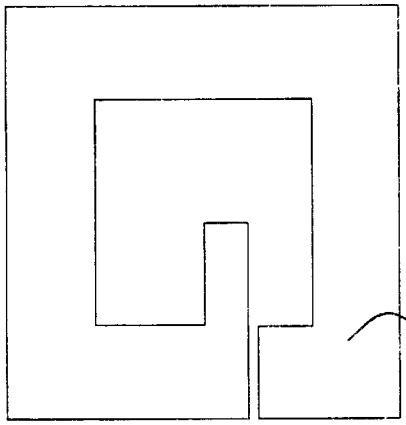
FIG. 11 is a plan view of the uppermost layer of the staggered solenoid inductor of FIG. 8.
Figure 12:
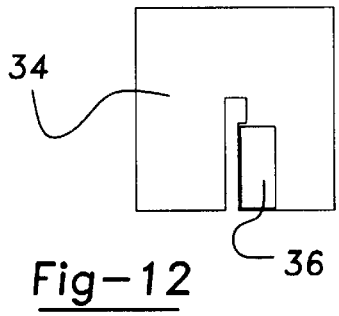
FIG. 12 is a plan view of a second layer of the staggered solenoid inductor, which is adjacent to the layer of FIG. 11.
Figure 13:
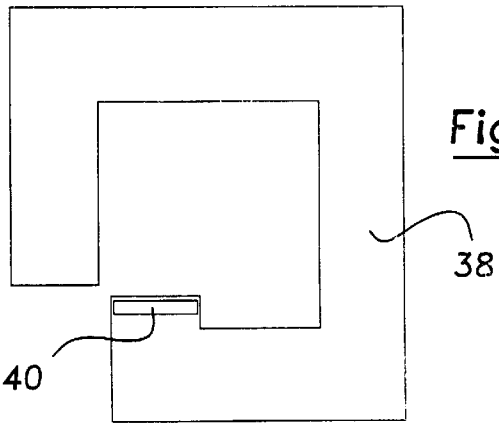
FIG. 13 is a plan view of a third layer of the staggered solenoid inductor, which is adjacent to the layer of FIG. 12.
Figure 14:
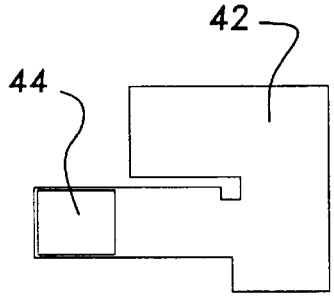
FIG. 14 is a plan view of a fourth layer of the staggered solenoid inductor, which is adjacent to the layer of FIG. 13.

FIGS. 1–7 depict a pyramid solenoid inductor 10 arranged in accordance with a first embodiment of the present invention. The pyramid solenoid inductor 10 consists of a series of concentric squares wound around a vertical axis with adjacent squares connected by a via. In this particular embodiment, the pyramid solenoid inductor 10 includes a topmost layer 12 connected to an adjacent layer 14 below layer 12. Layers 12 and 14 are electrically connected using a via 16 which provides electrical interaction between the layers. A third layer 18 is adjacent to layer 14 and is similarly interconnected by a via 20. Similarly, a fourth layer 22 is adjacent to layer 18 and is interconnected by a third via 24. As best shown in FIGS. 2 and 3, the interconnection of layers 12, 14, 18, and 22 results in a pyramid structure. The pyramid structure may be located within the layers of a substrate or may be self supporting.

The pyramid solenoid inductors of FIGS. 1–7 minimize interwinding capacitance because the only area of trace overlap between adjacent turns is at the vias 16, 20, and 24. Thus, the overall parasitic capacitance is equal to the series connection of low value fringe (or edge) capacitance between each layer. By adding additional layers (i.e., inductor turns) the capacitance will decrease and the inductance will increase, resulting in a larger inductance with a potentially higher self-resonant frequency (SRF). The pyramid solenoid inductor of FIGS. 1–7 also minimizes proximity effect because the turns are separated along the axial direction of the pyramid, resulting in a decrease in alternating current (AC) resistance and an increase in quality factor (Q). Further yet, the pyramid solenoid inductor enables variation of the inner-edge spacing (i.e., the spacing viewed along the axial direction) between adjacent traces to minimize surface area, thereby maximizing inductance per volume.

FIGS. 8–14 depict a staggered solenoid inductor 30 arranged in accordance with the principles of a second embodiment of the present invention. In general, the staggered solenoid inductor 30 includes alternating large and small turns wound around the vertical axis with the adjacent turns connected by a via. The staggering of alternating layers significantly reduces interwinding capacitance. The appropriate design and layout of each turn further reduces the capacitance between adjacent layers. The staggered solenoid inductor 30 includes a top layer 32. The top layer 32 electrically interconnects to a second layer 34 adjacent to the top layer 32 by a via 36. The second layer 34 electrically interconnects to a third layer 38 through a via 40. The third layer in turn attaches to a fourth layer 42 using a via 44.

In the staggered solenoid inductor 30 of FIGS. 8–14, adjacent turns contribute only low value fringe capacitance to the total interwinding capacitance of the inductor. The overlap between each alternating layer contributes plate capacitance, which is significantly higher in value than the fringe capacitance. The net effect of the fringe and plate capacitances is an interwinding capacitance which has a value on the order of the fringe capacitance, as will be described further herein with respect to FIGS. 15–18. Further, although the shape of each trace may be arbitrary, the shapes are selected to provide adjacent traces or layers which do not overlap in order to minimize parasitic capacitance.

In addition to the above design features, FIGS. 15–18 demonstrate the relationship between the number of layers and the interwinding capacitance. In order to minimize the parasitic capacitance, the staggered solenoid inductor 30 requires an even number of turns or layers. FIGS. 15–18 demonstrate the concept by comparing four and five turn staggered inductors.

Figure 15:
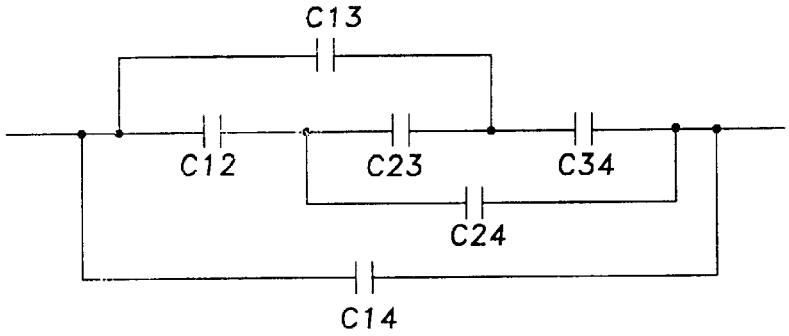
FIG. 15 is a circuit diagram of the interwinding capacitance of the staggered solenoid inductor of FIGS. 8–10.
Figure 16:
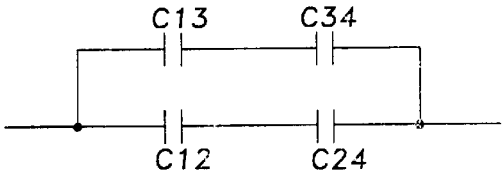
FIG. 16 is a circuit diagram showing the effective interwinding capacitance of the circuit of FIG. 15.

FIG. 15 is a circuit diagram depicting the interwinding capacitance model of the four turn staggered inductor shown in FIGS. 8–14. In FIG. 15, capacitance C14 may be represented by an open circuit or high impedance because the capacitance value is relatively small. Capacitors C12, C23, and C34 are due to fringe effects and are much less in value than C13 and C24 which are plate capacitances. In order to further simplify the model, capacitance C23 is opened due to its very small value and resultant high impedance. FIG. 16 depicts an equivalent capacitance network for FIG. 15. In the parallel connection of two series branches, each branch consists of a small valued fringe capacitor and a large valued plate capacitor. When C34 is much smaller than C13 and C12 is much smaller than C24, the equivalent circuit is the parallel connection of C34 and C12, or C34 plus C12. The sum of two small fringe capacitances results in a small valued interwinding capacitance. By making the interwinding capacitance small, the self resonant frequency (SRF) of the inductor is maximized.

Figure 17:
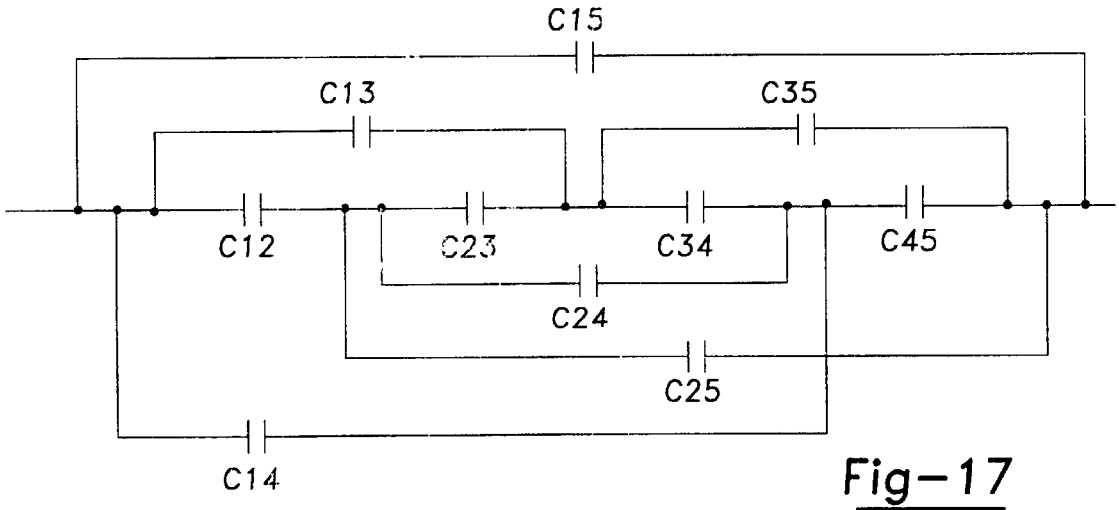
FIG. 17 is a circuit diagram showing the interwinding capacitance of a five turn staggered solenoid inductor.

In contrast to the four turn inductor, FIG. 17 depicts the capacitance model for a five turn staggered inductor. Similar to the description above, capacitances C15, C14, C25, C23, and C34 may be approximated by an open circuit or high impedance because the capacitances are relatively small. Also, because capacitances C12 and C45 are relatively small and capacitances C13, C35, and C24 are relatively large, an equivalent capacitance network can be demonstrated as shown in FIG. 18.

Figure 18:
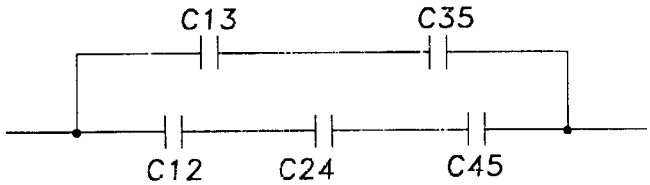
FIG. 18 is a circuit diagram showing the effective interwinding capacitance of the five turn staggered solenoid inductor.

The circuit branch in FIG. 18 containing C13 and C35 has a large effective capacitance value compared to the other branch containing C12, C24, and C45, which has a small effective capacitance value. This circuit thus simplifies into the parallel connection of a large and a small valued capacitance which is equivalent to a large valued capacitance. The lack of a small valued capacitor in the C13, C35 leg of the circuit is a direct result of the staggered inductor being constructed using an odd number of windings.

Thus, using the above-demonstrated design guidelines, staggered inductors having an even number of turns will inherently minimize the capacitance and maximize the SRF.

Further yet, this feature enables minimizing spacing between adjacent traces, thereby maximizing the inductance per volume. Further yet, because the staggered inductor structure reduces proximity effect the Q value increases.

Thus, from the foregoing it can be seen that this invention enables the design of a high valued, high current RF power inductor. By arranging adjacent layers so as to minimize capacitance, the resultant inductor provides improved SRF and Q, while minimizing component volume.

Although the invention has been described with particular reference to certain preferred embodiments thereof, variations and modifications can be effected within the spirit and scope of the following claims. In particular, rectangular, circular, and elliptical windings with an arbitrary number of layers are also possible.

What is claimed is:

1. An electrically conductive inductor comprising:

a plurality of turns which cooperate to form the inductor, each turn of the plurality being arranged along an axis and each turn occupies a distinct plane perpendicular to the axis, wherein any axial path through the inductor intercepts only one of the turns except at a via which provides an electrical connection between the adjacent turns, to define non-overlapping, adjacent turns, and wherein the non-overlapping, adjacent turns minimize electrical interaction between each adjacent turn, thereby minimizing capacitance of the inductor.

2. The inductor of claim 1 wherein each turn occupies a predetermined surface area, and adjacent turns overlap only at vias which provide electrical interaction between adjacent turns.

3. The inductor of claim 1 wherein the inductor is pyramid shaped.

4. The inductor of claim 3 wherein each turn of the plurality is progressively either larger or smaller than an adjacent turn along the axis of the inductor, and each adjacent turn overlaps only at a via which provides an electrical connection.

5. The inductor of claim 1 wherein the inductor turns are staggered.

6. The inductor of claim 5 wherein each turn occupies a predetermined surface area, and adjacent turns overlap only at vias which provide electrical interaction between adjacent turns.

7. An embedded solenoid inductor comprising:

a first electrically conductive turn occupying a first surface area and arranged in a first plane perpendicular to a solenoid axis;

a second electrically conductive turn adjacent to the first turn and arranged in a second, distinct plane adjacent to the first plane and arranged so that the first and second electrically conductive turns do not overlap when viewed from an axial direction, except at selected portions which overlap to provide an electrical interconnection between the adjacent turns, wherein the non-overlapping, adjacent turns minimize electrical interaction between each adjacent turn, thereby minimizing capacitance of the inductor.

8. The embedded solenoid inductor of claim 7 wherein the solenoid inductor has a generally stair-step shape when viewed perpendicularly to the solenoid axis.

9. The embedded solenoid inductor of claim 7 further comprising:

a third electrically conductive turn adjacent to the second turn, and arranged in a third distinct plane adjacent to the second plane, the second and third electrically conductive turns do not overlap when viewed from an axial direction, except at portions which minimally overlap to provide an electrical interconnection between the adjacent second and third turns; and a fourth electrically conductive turn adjacent to the third turn, and arranged in a fourth distinct plane adjacent to the third plane, the third and fourth electrically conductive turns do not overlap when viewed from an axial direction, except at portions which minimally overlap to provide an electrical interconnection between the adjacent third and fourth turns.

10. The embedded solenoid inductor of claim 9 wherein the solenoid inductor has a generally stair-step shape when viewed perpendicularly to the solenoid axis, each adjacent turn in a first axial direction occupying less surface area than the adjacent turn in an opposite axial direction.

11. The embedded solenoid inductor of claim 7 wherein one of the first or second turns defines a border which generally surrounds the other of the first or second turns.

12. The embedded solenoid inductor of claim 11 further comprising:

a third electrically conductive turn adjacent to the second turn, and arranged in a third distinct plane adjacent to the second plane, the second and third electrically conductive turns do not overlap when viewed from an axial direction, except at portions which minimally overlap to provide an electrical interconnection between the adjacent second and third turns and a fourth electrically conductive turn adjacent to the third turn, and arranged in a fourth, distinct plane adjacent to the third plane, the third and fourth axial direction, except at portions which minimally overlap axially to provide an electrical interconnection between the adjacent third and fourth turns.

13. The embedded solenoid inductor of claim 12 wherein one of the third or fourth turns generally defines a border which surrounds the other of the third or fourth turns.

14. The embedded solenoid inductor of claim 13 wherein the first and third turns may overlap when viewed from an axial direction, and the second and fourth turns may axially overlap when viewed from an axial direction.

* * * * *